United States Patent [19]

Balsbaugh

[11] Patent Number: 4,807,929

[45] Date of Patent: Feb. 28, 1989

[54] STACKABLE CHAIR WITH SLIDING COMPARTMENT

[76] Inventor: Vernon L. Balsbaugh, 2510 Liberty Rd., Dallas, Oreg. 97338

[21] Appl. No.: 120,402

[22] Filed: Nov. 13, 1987

[51] Int. Cl.[4] ..... A47C 7/62

[52] U.S. Cl. ..... 297/191; 297/239

[58] Field of Search ..... 297/191, 239; 211/88, 211/31, 94.5

[56] References Cited

U.S. PATENT DOCUMENTS

| | | | |
|---|---|---|---|
| 2,841,210 | 7/1958 | Nesselrodt | 297/191 |
| 2,841,211 | 7/1958 | Thompson | 297/191 |
| 3,402,963 | 9/1968 | Fujioka et al. | 297/239 X |
| 4,589,124 | 5/1986 | Ruiz | 297/191 X |
| 4,668,010 | 5/1987 | Fujiwara | 297/191 X |

FOREIGN PATENT DOCUMENTS

| | | | |
|---|---|---|---|
| 325387 | 6/1970 | Sweden | 297/191 |

*Primary Examiner*—James T. McCall

*Attorney, Agent, or Firm*—Charles N. Hilke

[57] ABSTRACT

A stackable chair having a sliding compartment such that the stackable chairs may be placed one on top of the other without the necessity of removing the sliding compartment. The sliding compartment is attached to the back of the back rest of the stackable chair by slide guides. The top of the back rest of the stacked chair meets the bottom of the slideable shelf of the chair being stacked, and causes the slideable shelf to move upward within slide guides until the chair is firmly positioned on the stacked chair. Each additional chair to be stacked is accomplished in the same fashion.

2 Claims, 2 Drawing Sheets

STACKABLE CHAIR WITH SLIDING COMPARTMENT

BACKGROUND OF THE INVENTION:

1. Nature of the Invention:

The present invention relates to a stackable chair with a sliding compartment and, more particularly, to a sliding compartment mounted on a chair so that the chair may be stored without removal of the sliding compartment.

2. Nature of the Prior Art:

Bookracks have been attached to folding chairs. In U.S. Pat. No. 2,841,210, a rack member is attached to the back side of the back rest by means of screws. In U.S. Pat. No. 2,841,211, a book box is held in place on the back side of a folding chair by means of lengths which fit within disc flanges. In U.S. Pat. No. 2,890,800, a book holder for folding chairs which uses a shaped wire positioned on the back of the back rest of the folding chair. In U.S. Pat. No. 2,897,976, a book rack attachment is in hanging position from the top of the armrest where projecting beads fit into the side of the back of the back rest. In U.S. Pat. No. 3,856,359, a stackable chair with an attached kneeler is disclosed where the kneeler may be retractably positioned under the seat of the stackable chair. Of further interest are U.S. Pat. Nos. 2,584,179 and 2,278,014 and 3,387,882, which disclose, respectively, an adjustable card holder support, a detachable table for the back of chairs, and a collapsible desk structure.

None of the prior art discloses a slideable book rack or compartment which may be continuously attached to the chair when the chair is stacked. This is often necessary in modern churches, so that additional seating space or additional standing space may be readily provided.

SUMMARY OF THE INVENTION

The general purpose of the present invention is to provide a slideable shelf for a stackable chair such that the slideable shelf does not need to be removed when the chairs are stacked.

A sliding compartment is comprised of slide guides which are attached to the back rest support arm. The book shelf, by means of a slide guide edge, fits within the slide groove of the shelves' sides. A stop extends from the base of the slide guide to prevent the book shelf from sliding downward out of the slide guides. When the stackable chairs are placed one on top of the other, the top of the back rest pushes against the bottom of the book shelf causing it to slide upward on the slide guide until the chair legs are in stackable position. By appropriate geometrical relationships, the book shelf remains within the slide guides when the chairs are in stacked position.

While the slide guides can be attached directly to the back rest support arms, they can also be attached directly to the back of the back rest of the chair or to additional supports attached to the back of the back rests of the chair.

Accordingly, an object of the present invention is to provide a sliding compartment which does not need to be removed when chairs are stacked.

Another object is to provide a simple yet durable sliding compartment.

Another object is to provide a low cost book shelf.

It is another further object to make the sliding compartment easily accessible, rather than inaccessible, for example, under the chair seats.

Finally, an object is to provide a slideable book shelf positionable on different types of stackable chairs.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
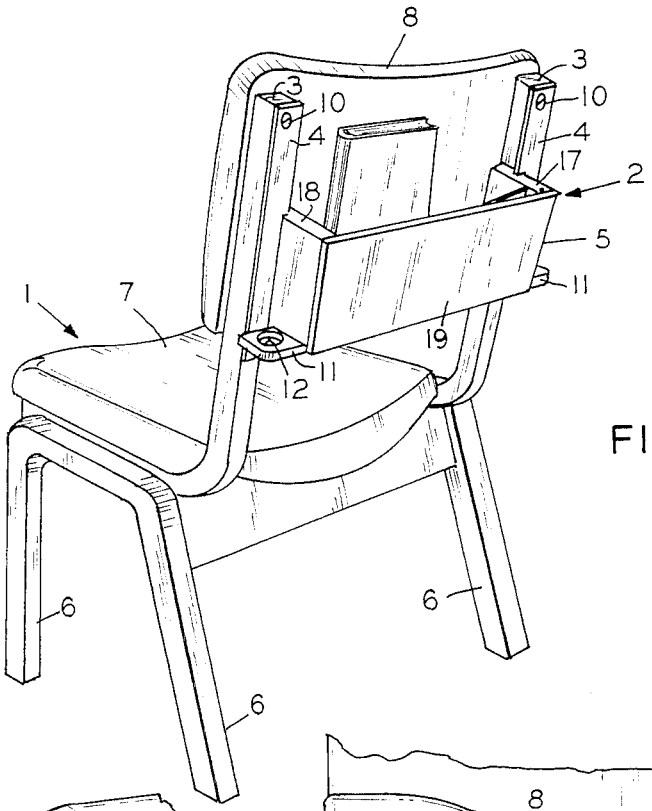
FIG. 1 is a perspective back view of a chair with the slideable shelf at its lowest position.

Referring now to FIG. 1, a typical stackable chair 1 with chair seat 7 and chair legs 6 is shown with the sliding compartment 2 attached to the back of the chair 1 at the back rest support arm 3. The sliding compartment 2 is shown in its lower most position with the slide guide 4 attached to the back rest support arm 3. The book shelf 5 with a book is shown slideably positioned on the slide guide 4.

Figure 2:
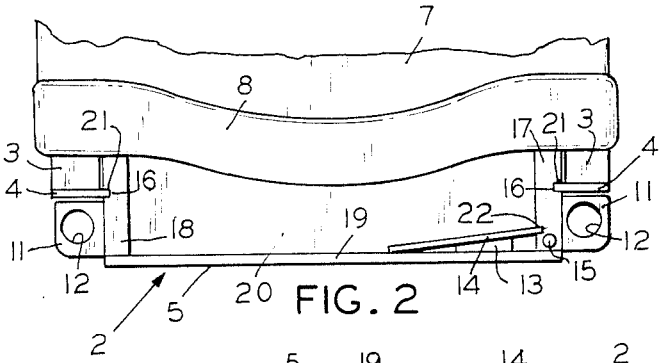
FIG. 2 is a top view of the sliding compartment and back rest.

In FIG. 2, the back rest 8 is shown with the back rest top 9. Back rest support arms 3 support the slide guide 4 where the slide guide edge 16 is positioned within the slide groove 21. The slide groove 21 is positioned in the sides 17 and 18 of the book shelf 5. The book shelf 5 contains a back 19 to which a block 13 is attached to support envelope box 14. One side of envelope box 14 is positioned in box slide 22 located on side 17. In addition, a pencil receiving hole 15 is drilled in side 17. Communion cup support 11 contains a hole 12 for positioning of a communion cup.

Figure 3:
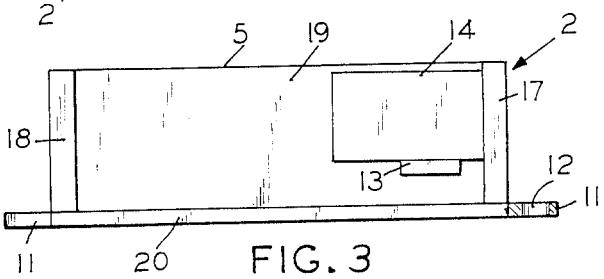
FIG. 3 is a back view along lines 3—3 of FIG. 4, showing the inside of the book shelf.

FIG. 3 shows the bottom 20 of book shelf 5, along with another view of the envelope box 14 and block 13. Also shown in cutout is the communion cup support 11 with hole 12.

Figure 4:
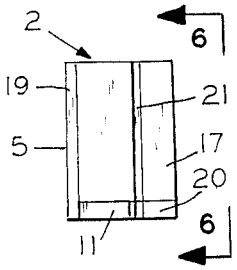
FIG. 4 is a side view of the book shelf.

FIG. 4 shows a detailed view of the side 17 with the slide groove 21. Also shown is back 19 and the bottom 20 of book shelf 5. The communion cup support 11 is also shown.

Figure 5:
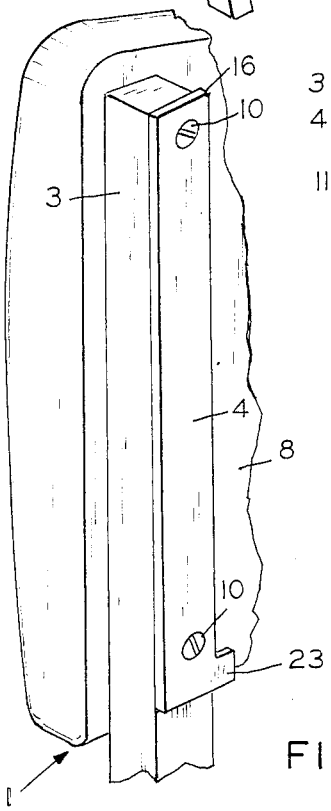
FIG. 5 is a perspective view of the slide guide.

FIG. 5 shows the attachment screws 10 fixably attaching the slide guide 4 to the back rest support arm 3. The stop 23 prevents the book shelf 5 from sliding off in a downward fashion from the slide guide 4. In another embodiment with a different style stackable chair, the slide guide 4 may be directly attachable to the back of the back rest 8 or may use a length of wood which is attached to the back side of the back rest 8 for attachment of the slide guide 4.

Figure 6:
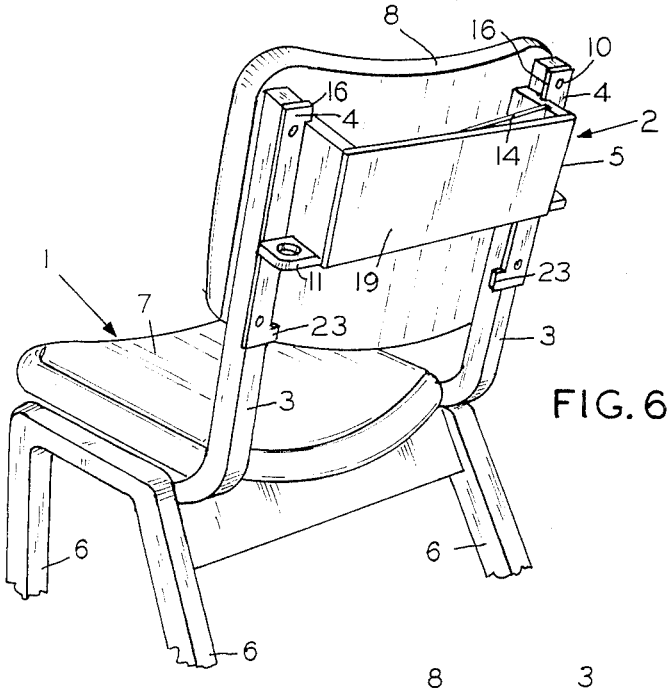
FIG. 6 is a perspective view of the chair with the sliding compartment in the top most position.

In FIG. 6, the book shelf 5 is positioned above the stop 23 to show the slideability of the book shelf 5.

Figure 7:
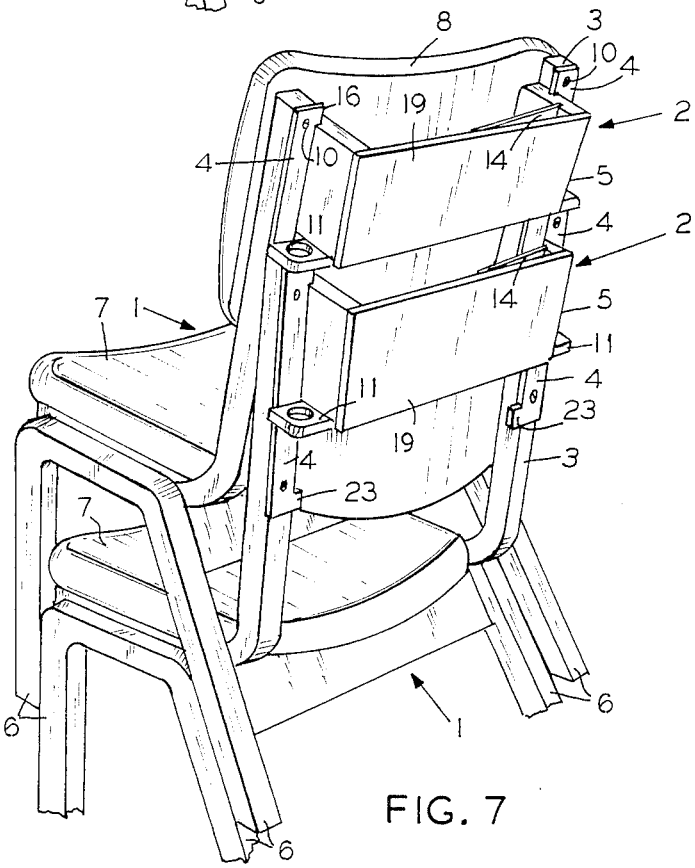
FIG. 7 is a perspective view showing the two chairs in stackable position with both sliding compartments in their top most position.

FIG. 7 shows two chairs in stackable position with the top book shelf 5 positioned on back rest top 9 of the base chair's back rest 8. Note that in this style of stackable chair, the chair legs 6 determine the position of the stacking of the chairs. This sets out the geometrical relationship to make sure that the book shelf 5 does not slide off the top of the slide guides 4.

Reviewing FIG. 7, a stackable chair is placed on top of another stackable chair. The back rest top 9 of the base chair 1 will come into contact with the bottom 20 of the book shelf 5 of the chair to be stacked. This causes the book shelf 5 to slide up the slide guide 4 by means of the slide guide edge 16 and the slide groove 21. Once the top chair's legs 6 are positioned on the lower chair's legs 6, the two chairs 1 are stacked. The book shelf 5 on the top most chair is in its upper most position. Note that the lower chair's book shelf 5 can remain filled with books, etc., and will not contact any part of the upper chair. This eliminates any necessity of emptying book shelves before stacking the chairs.

When unstacking the chairs, the top chair is simply lifted upwards. Gravity causes the book shelf 5 to slide down the slide guides 4 until the stop 23 prevents the downward movement of the book shelf 5.

Of course, the geometrical relationship may be varied, depending upon the designer of the chairs and how the stackable chairs are stacked. It is only necessary to properly place the slide guides 4 and book shelf 5 such that the book shelf 5 is not able to slide over and off the slide guides 4. In addition, the sliding compartment 2 may be attached directly to the back rest 8 of the chair 1 if the style of the chair is such that back rest support arms 8 do not raise to the proper height.

Obviously many modifications and variations of the present invention are possible in light of the above features. It is therefore to be understood that within the scope of the appended claims, the invention may be practiced otherwise or as specifically described.

I claim:

1. A stackable sliding compartment, comprising:

a chair having a seat, four chair legs, and a back rest, said chair being stackable with other chairs of similar configuration;

at least one slide guide fixably mounted on the back side of said back rest;

a book shelf slidably mounted within said slide guide where said book shelf is adjacent to the back side of the back rest of said chair where the positioning of the lower chair's back rest top is in contact with the bottom of the upper chair's said book shelf;

a slide groove on said book shelf within which slidably fits a slide guide edge of said slide guide which permits the book shelf to slide up and down on said slide guide;

a stop at the lowermost point of said slide guide for holding said book shelf at its lowermost position; and where positioning said slide guide so that the book shelf stays within the slide guide when the lower chair's back rest top is in contact with the bottom of the upper chair's book shelf and said upper chair is stacked on said lower chair.

2. The stackable sliding compartment of claim 1 additionally comprising positioning said lower chair's book shelf such that contents within said lower chair's book shelf do not contact any portion of said upper chair.

* * * * *